US007456395B2

(12) United States Patent
Rottmann et al.

(10) Patent No.: US 7,456,395 B2
(45) Date of Patent: Nov. 25, 2008

(54) GLOW DISCHARGE SOURCE

(75) Inventors: Lothar Rottmann, Ganderkesee (DE); Wolfgang Schöttker, Bremen (DE); Nicole Frerichs, Oldenburg (DE)

(73) Assignee: Thermo Electron (Bremen) GmbH, Bremen (DE)

( * ) Notice: Subject to any disclaimer, the term of this patent is extended or adjusted under 35 U.S.C. 154(b) by 373 days.

(21) Appl. No.: 11/336,491

(22) Filed: Jan. 20, 2006

(65) Prior Publication Data

US 2007/0040112 A1 Feb. 22, 2007

(30) Foreign Application Priority Data

Jan. 26, 2005 (DE) ..... 10 2005 003 806

(51) Int. Cl.
*H01J 49/00* (2006.01)

(52) U.S. Cl. ..... 250/288; 250/423 R; 250/424; 250/281; 250/282

(58) Field of Classification Search ..... 250/288, 250/423 R, 424, 425, 281, 282
See application file for complete search history.

(56) References Cited

U.S. PATENT DOCUMENTS

| | | | | |
|---|---|---|---|---|
| 3,633,990 | A * | 1/1972 | Baierlein | 356/321 |
| 3,949,230 | A | 4/1976 | Bach | |
| 4,853,539 | A | 8/1989 | Hall et al. | |
| 5,006,706 | A | 4/1991 | Marcus | |
| 5,408,315 | A * | 4/1995 | Mitchell et al. | 356/311 |
| 5,646,726 | A * | 7/1997 | Mitchell et al. | 356/311 |
| 5,937,541 | A * | 8/1999 | Weigand et al. | 34/565 |
| 6,063,243 | A * | 5/2000 | Zettl et al. | 204/164 |
| 6,822,229 | B2 | 11/2004 | Wilken et al. | |
| 2001/0029110 | A1 * | 10/2001 | Lee et al. | 438/780 |
| 2002/0148941 | A1 * | 10/2002 | Sorokov et al. | 249/114.1 |
| 2002/0179428 | A1 * | 12/2002 | Anazawa et al. | 204/173 |
| 2003/0029172 | A1 * | 2/2003 | Suthoff | 62/3.1 |
| 2003/0116706 | A1 * | 6/2003 | Wilken et al. | 250/288 |
| 2004/0134612 | A1 * | 7/2004 | Numata | 156/345.37 |
| 2004/0168906 | A1 * | 9/2004 | Hirakata et al. | 204/173 |

FOREIGN PATENT DOCUMENTS

| | | | |
|---|---|---|---|
| DE | 19953782 | A1 * | 7/2000 |
| EP | 0 249 424 | B1 | 9/1994 |
| JP | 08075654 | A * | 3/1996 |
| JP | 2004151042 | A * | 5/2004 |
| JP | 2004271468 | A * | 9/2004 |

* cited by examiner

*Primary Examiner*—Jack I. Berman
*Assistant Examiner*—Michael J Logie
(74) *Attorney, Agent, or Firm*—Laurence P. Colton; Smith, Gambrell & Russell

(57) ABSTRACT

A glow discharge source, in particular for the analysis of solid specimens by means of glow discharge, with an anode and a cathode and with means for the direct or indirect cooling of a specimen, and at least one Peltier element provided as the cooling means.

65 Claims, 6 Drawing Sheets

GLOW DISCHARGE SOURCE

BACKGROUND OF THE INVENTION

The invention relates to a glow discharge source, in particular for the analysis of solid specimens by means of glow discharge, with an anode and a cathode and with means for the direct or indirect cooling of a specimen. Glow discharge sources are known, inter alia, in the form of ion sources for mass spectrometric analyses. In the glow discharge source, the surface of a specimen is removed and ionized by a plasma. The ions originating from the specimen are discharged from the source and fed to a mass spectrometer.

The solid specimen is heated up by the plasma. Cooling of the specimen is advantageous, to avoid melting. This applies in particular to thin specimens or systems of layers. A constant specimen temperature is also advantageous for the accuracy and reproducibility of the measurement results. Finally, the stability of the removal of the specimen surface sputter process is to be ensured.

In known devices, the cooling of the specimen takes place with the aid of water. In this case, only temperatures near freezing can be achieved without additives. For specimens with a low melting point, this is possibly not adequate, for example for gallium (Ga). With this type of cooling, the rate of temperature change is also low.

Finally, it is advantageous to be able to heat up the specimen after cooling to avoid condensation. This requires additional technical measures.

BRIEF SUMMARY OF THE INVENTION

With the present invention it is intended to improve the cooling of the specimen in the region of the glow discharge source.

The glow discharge source according to the invention is characterized in that at least one Peltier element is provided as the cooling means. When a voltage is applied to the Peltier element, one side is cooled, while the opposite side of the element is heated up. The heat is accordingly transported from one side to the opposite side. If the voltage at the Peltier element is reversed, the direction of heat flow changes correspondingly.

With the Peltier element, rapid temperature changes are possible and relatively low temperatures, even below 0° C., can be achieved. For heating the specimen to avoid condensation, it is merely necessary to reverse the voltage.

According to a further idea of the invention, the Peltier element is arranged between the anode and the cathode of the glow discharge source. In this case, one of the two parts is cooled and the other is heated up. The Peltier element is preferably formed as an insulator, for instance with ceramic surfaces, so that there is good electrical insulation between the anode and the cathode.

According to a further idea of the invention, it is provided that the Peltier element lies against the cathode and cools it, and the cathode lies against the specimen. The Peltier element absorbs the heat of the cathode and the latter absorbs the heat of the specimen until there is a state of equilibrium that can be controlled by the Peltier element. By reversing the voltage at the Peltier element, heating up of the specimen is also possible in a simple way.

According to a further idea of the invention, means for cooling the anode are provided. The thermal energy of the cathode is transferred to the anode through the Peltier element. The said anode can be correspondingly cooled and, for this purpose, preferably has channels for a flowing cooling medium to flow through. Cooling water or some other cooling liquid is preferred. Gas cooling is also possible. The anode is advantageously at earth potential, so that a flowing coolant is unproblematical in this region.

According to a claimed idea of the invention that is also independent of the use of the Peltier element, the cathode of the glow discharge source consists of a material, that has a great hardness with at the same time good thermal and electrical conductivity. The high-grade steel that is usually used does not have particularly good properties in this respect. The mechanical hardness is also important, because the specimen lies against the cathode and, if the cathode does not have adequate hardness, its surface may scratch and influence the electrical and thermal transfer between the specimen and the cathode, and consequently also the subsequent measurement results.

In particular, the cathode material has the property a) and at least one of the subsequent properties b), c):

a) the Vickers hardness (HV) of a surface facing the specimen is at least 120,
b) the electrical conductivity is at least 14% ICAS, the ICAS value usually being normalized to the electrical conductivity of copper (100%),
c) the thermal conductivity is at least 80 W(mK).

The cathode materials used preferably have all three stated properties a) to c).

The cathode is preferably produced from materials with the following properties:

a) the Vickers hardness (HV) of a surface facing the specimen is at least 120, preferably at least 180, in particular at least 210,
b) the electrical conductivity is at least 14% ICAS, preferably 20% ICAS, in particular at least 30% ICAS, and
c) the thermal conductivity is at least 80 $Wm^{-1}K^{-1}$, preferably at least 100 $Wm^{-1}K^{-1}$, in particular at least 120 $Wm^{-1}K^{-1}$.

The presented variations of the various properties can be combined with one another as desired. Of course, a material that has the maximum values for all the stated properties is best.

The cathode is preferably produced from at least one, in particular precisely one, of the following materials:

W75Cu25,
WCu,
CrZrCu,
CoBeCu,
WAg,
W90NiCu,
CuBe2,
WNiCu,
CuNiBe,
CuCoNiBe,
CuNiCrSi,
CuCr,
WCAg.

At least in the case of a cathode constructed from a number of paths, the various materials may also be combined with one another.

According to a further idea of the invention, the specimen is formed as a pin and is inserted in a conducting manner with part of its length in a corresponding recess in the cathode and protrudes with another part of its length into a recess in the anode, without touching the latter. In the case of this embodiment, the cathode acts as a pin holder or specimen holder. The pin-shaped specimen is inserted in the cathode in a clamping manner. In this case, the cathode is of a multipart form, with an annular part, into which the anode partly protrudes, and with a substantially disc-shaped or block-shaped part for receiving the specimen and at the same time for covering the annular cathode part.

According to a further idea of the invention that is independent of the use of the Peltier element and the special cathode material, a covering of the cathode is provided in such a way that the specimen is completely covered and the covering has a peripheral sealing edge with respect to the cathode, it being possible for a volume between the covering and the specimen to be extracted by suction and, for this purpose, the covering has a connection for suction extraction. Inside the glow discharge source there is a vacuum or a pressure of approximately 1 mb (0.1 to 10 mb). A pressure-tight arrangement of the specimen at the cathode, for instance with a (very flat) sealing ring lying in between, has previously been customary. This hinders the electrical and thermal transfer between the cathode and the specimen. With the solution according to the invention, that of the covering described, there is no need for the sealing between the specimen and the cathode.

According to a further idea of the invention, the cathode may be formed in a divided manner, a part near the specimen being removable together with the specimen and the covering from a part of the cathode remote from the specimen. This measure makes particularly simple changing of the specimen possible. A new specimen can be fixed on the part of the cathode near the specimen outside the glow discharge source and then subsequently placed together with it onto the part of the cathode remote from the specimen. A vacuum seal is correspondingly provided between the two parts of the cathode.

Further features of the invention can be taken from the remaining description and the claims. Advantageous exemplary embodiments are explained in more detail below on the basis of drawings, in which:

DETAILED DESCRIPTION OF THE PREFERRED EMBODIMENTS

Figure 1:
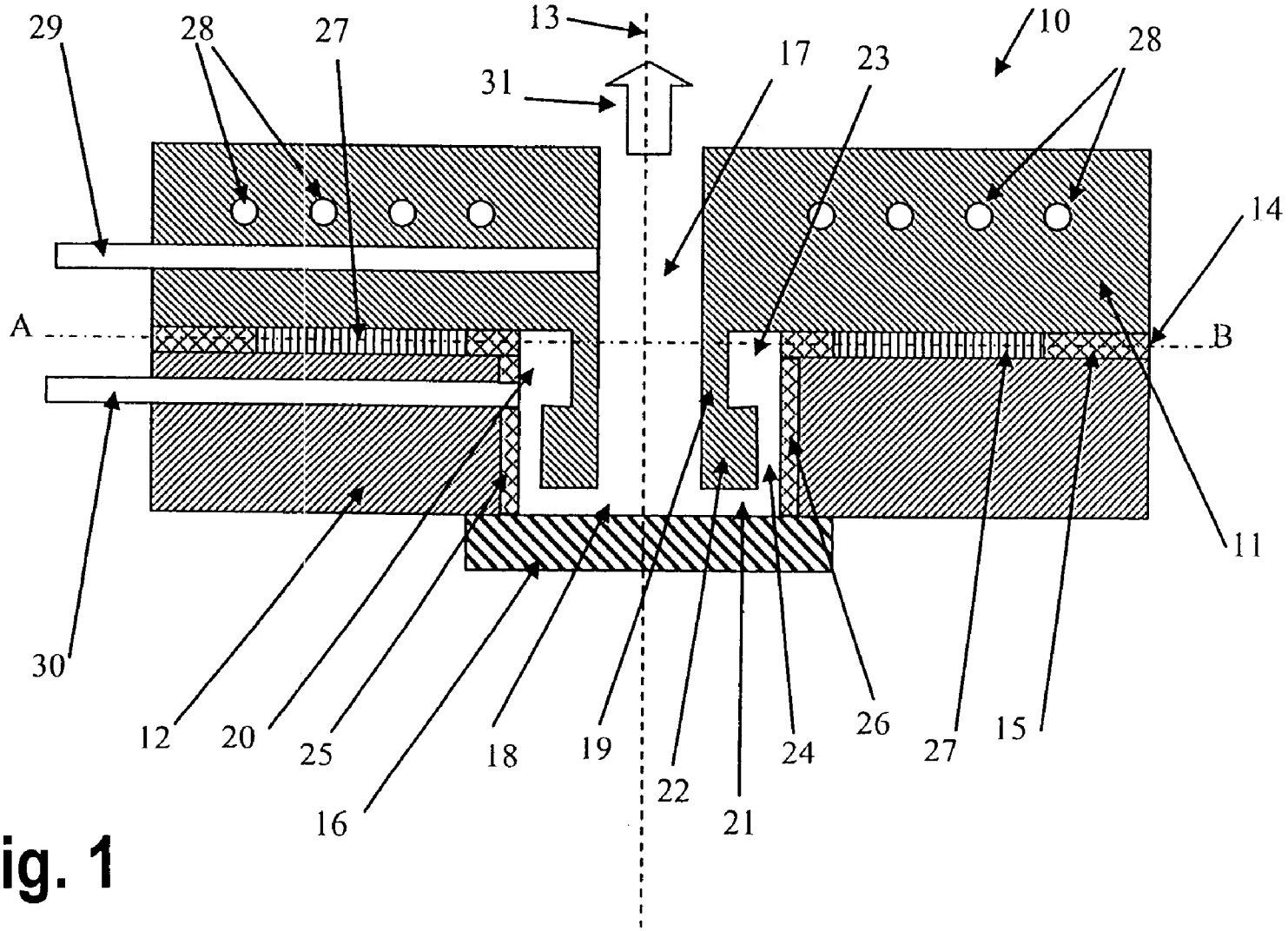
FIG. 1 shows a section along a centre axis of a first embodiment of the glow discharge source according to the invention.

The figures show a glow discharge source 10 of the Grimm type. The anode 11 and the cathode 12 are formed in a substantially annular manner, with a common centre axis 13. Provided between the anode 11 and the cathode 12 is a gap 14, which is partly filled by a substantially disc-shaped insulator 15. The gap 14 in this case runs perpendicular to the centre axis 13.

Opposite from the gap 14, a specimen 15 is held on the cathode 12 by devices not shown in any more detail. A good electrical and thermal transfer is to be ensured between the specimen 16 and the cathode 12.

Extending along the centre axis 13 is a free volume 17 with a cathode fall 18 near the specimen 16. The cathode 12 has as a rule a much larger inside diameter than the anode 11. Furthermore, the sleeve-like continuation 19 of the anode 11 extends into the cathode 12 and in the direction of the specimen 16.

Between the sleeve-like continuation 19 and the relatively outer cathode 12 there is formed an annular volume 20, which is in communication with the glow discharge zone 18 via a radially directed volume 21. In this case, the radial volume 21 is delimited in the axial direction on the one hand by the specimen 16 and on the other hand by the continuation 19. The latter has in its region facing the specimen 16 an outwardly directed thickening 22, so that the annular volume 20 is subdivided into a wide portion 23 near the gap 14 and a narrow portion 24 at the level of the thickening 22.

A substantially sleeve-shaped insulator 25 is provided on a circumferential inner side 26 of the cathode 12. In this case, the insulator 25 extends from the insulator 15 to the specimen 16, so that there is no "visible clearance" between parts of the anode 11 and of the cathode 12.

Figure 4:
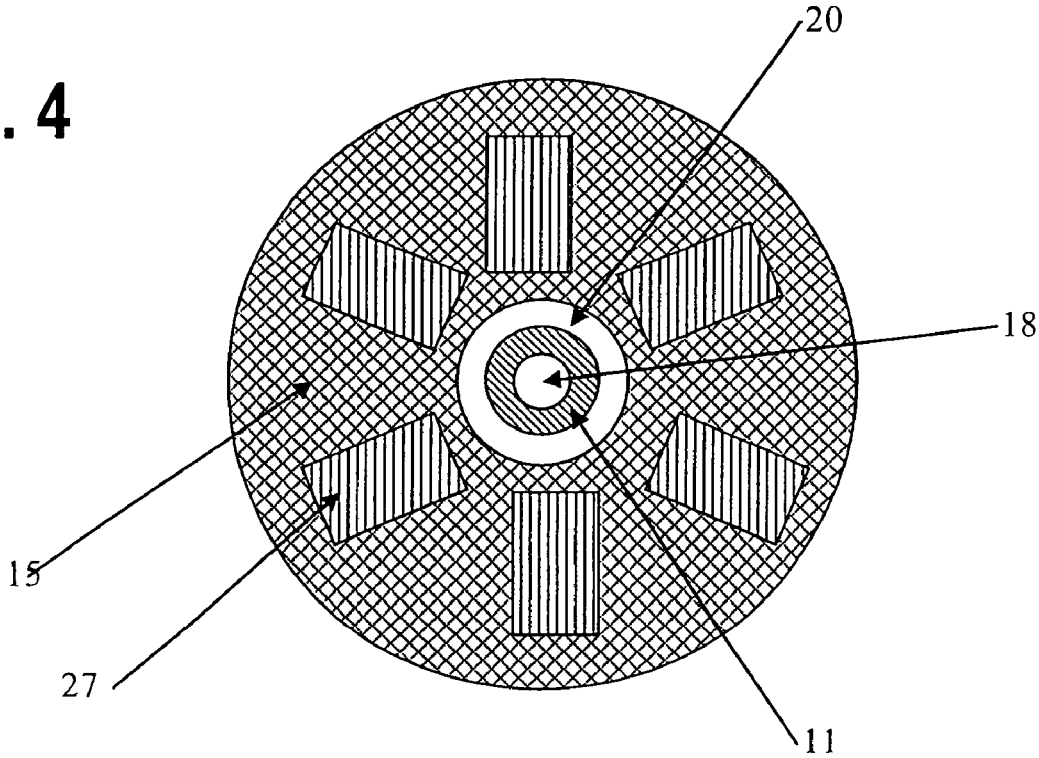
FIG. 4 shows a section along the line A-B in FIGS. 1-3.

In the region of the insulator 15, a number of Peltier elements 27, that is six in this case, are arranged between the anode 11 and the cathode 12 in the circumferential direction, see also FIG. 4. These lie against the anode 11 and the cathode 12 on the upper side and underside in such a way that good heat transfer is ensured. At the same time, the Peltier elements 27 are produced from ceramic material in order to ensure electrical insulation. They are preferably Peltier elements each with 30 watts, it being intended that the total output of 180 watts is greater than or equal to the output of the glow discharge. Peltier elements of this kind are, for example, the high-temperature elements PF-127-10-13 (silicone-sealed) from Telemeter Elektronik GmbH with $I_{max}$ 3.9 amperes, $U_{max}$ 16.4 volts, $P_{cmax}$ 35.6 watts, δT: 72° Celcius. The dimensions of the parts arranged around the Peltier elements 27 are such that the Peltier elements 27 lie against the anode 11 and the cathode 12 without a gap or via intermediate layers and there are good heat transfers.

The Peltier elements 27 are connected in a way not shown in any more detail to an electrical voltage source and cool the cathode 12 directly, and consequently cool the specimen 16 indirectly. At the same time, the anode 11 is directly heated up. A voltage reversal at the Peltier elements 27 is possible. This allows, for example, the specimen 16 to be heated up after carrying out the measurement in order to avoid condensation forming after the vacuum is eliminated in the region of the specimen.

The anode 11 is provided with devices for cooling. In the present example, the anode 11 has cooling channels 28, which extend in particular in the circumferential direction, receive a flowing cooling medium and can be connected in a way not shown in any more detail to an external cooling unit.

Argon flows into the glow discharge source 10 as the process gas, here through at least one radially directed channel 29, which opens out into the free volume 17 and extends in the anode 11 between the cooling channels 28 (lying in a radial plane) and the Peltier elements 27.

In a corresponding way, the cathode 12 has at least one radially directed outflow channel 30, which is connected to the annular volume 20 or to the wide portion 23 of the same, and for this purpose penetrates through the insulator 25.

The process gas ionizes in the region of the free volume 17 and ions detach particles from the surface of the specimen 16, which are taken away from the specimen 16, in the direction of the arrow 31 along the free volume 17 and fed to a mass spectrometer (not shown).

The cathode 12 is produced from a particularly hard and at the same time electrically and thermally conductive material, preferably from a tungsten-copper alloy with a tungsten content of 75% and, correspondingly, a copper content of 25%.

During operation, a pressure of approximately 0.1 to 10 mb prevails in the glow discharge zone 18. The cooling provided allows specimens at temperatures well below 0° Celcius to be analyzed, for example down to 70 Kelvins below the temperature of the anode, which is cooled by cooling water.

The temperature of the Peltier elements or the specimen can be kept constant by means of a control circuit (not shown). What is important in this connection is that the output of the Peltier elements is made to match the thermal output occurring in the glow discharge source 10.

The arrangement of Peltier elements may also be provided at some other location, for instance directly for cooling the specimen. Likewise, removal of the heat to the anode 11 is not mandatory.

In the present case, the anode 11 is at earth potential, while the cathode 12 and the specimen 16 are under voltage.

Figure 2:
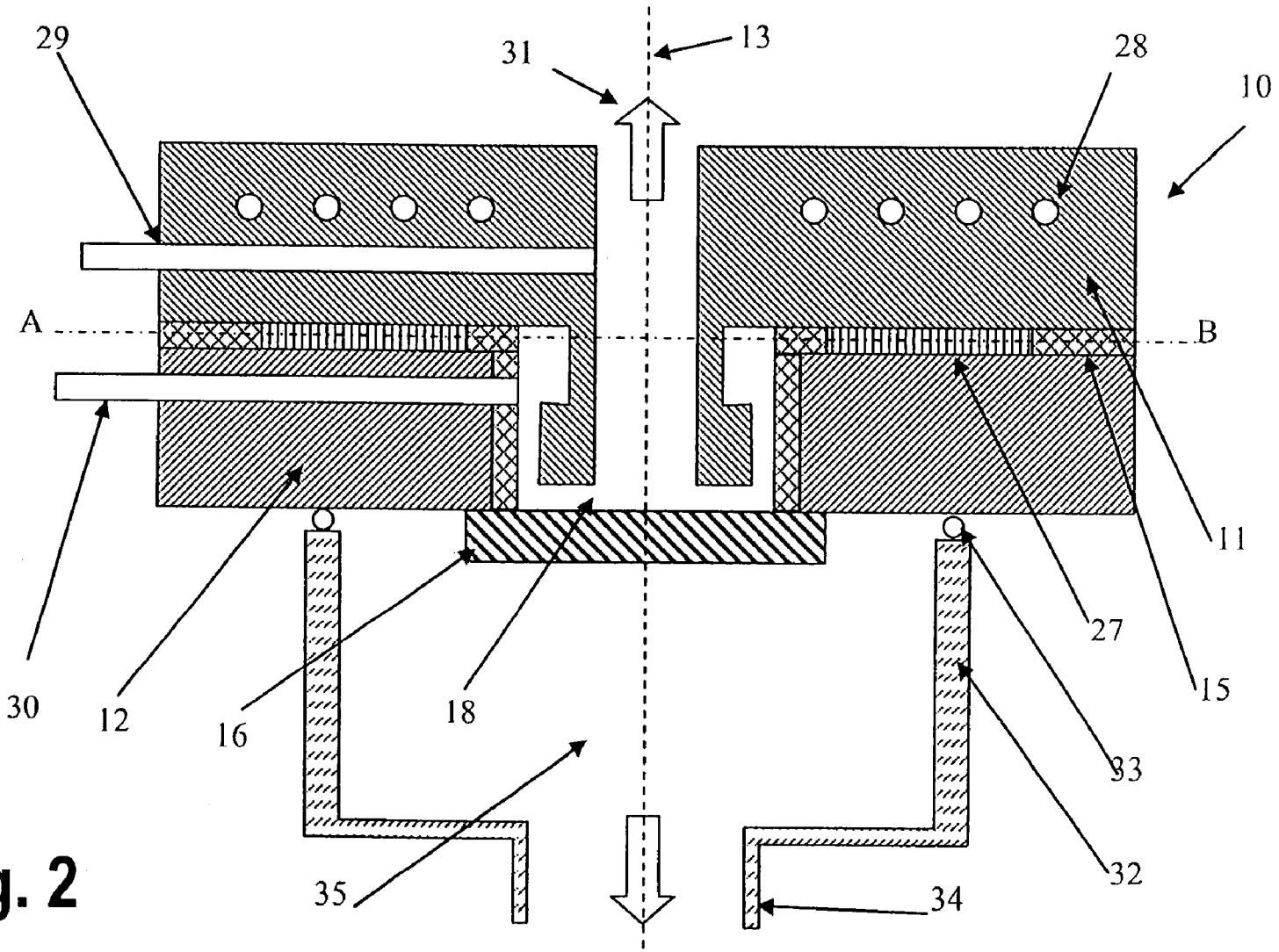
FIG. 2 shows an embodiment similar to FIG. 1, but with a covering over the specimen.

FIG. 2 shows a further exemplary embodiment. Here, the specimen 16 is covered by a covering, that is a housing 32, which takes the form of a cover with a peripheral seal 33 at the edge. The said seal lies against the cathode 12 at a distance from the specimen 16. The housing 32 has approximately at the centre and opposite the specimen 16 a connecting piece 34 for a vacuum line. An interior space 35 of the housing 32 is largely evacuated, preferably with a residual pressure which corresponds approximately to the pressure in the glow discharge source 10 or, if appropriate, is somewhat higher. Holding devices for the specimen are present but not depicted.

The particular advantage of the housing 32 is that the specimen 16 does not have to be arranged in a vacuum-tight manner with respect to the cathode 12. Special sealing means between the cathode 12 and the specimen 16 can therefore be avoided.

Figure 3:
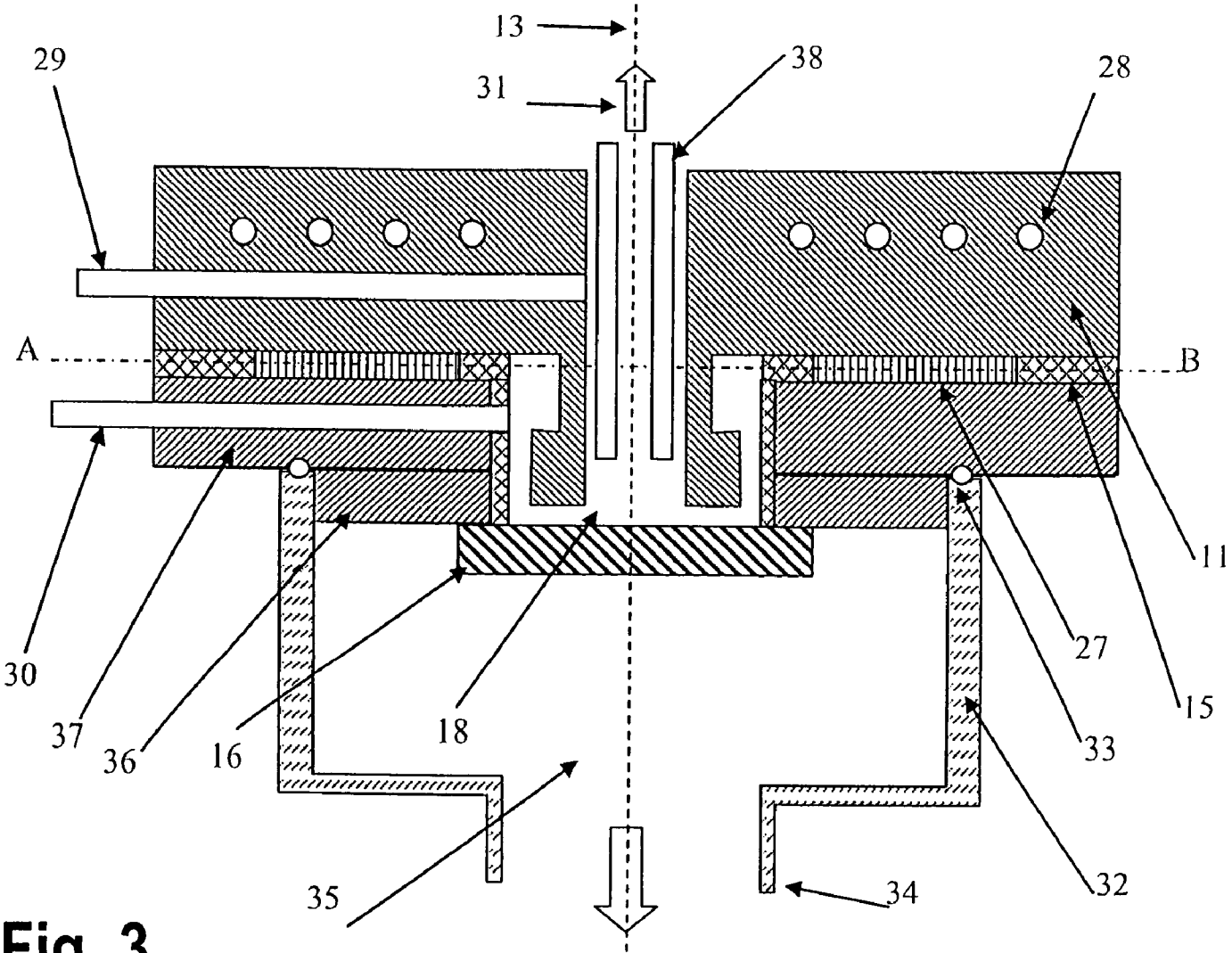
FIG. 3 shows an embodiment similar to FIG. 2, but with a covering and a divided cathode.

Finally, FIG. 3 shows a further embodiment. Here, the housing 32 is likewise provided. By contrast with the embodiment shown in FIG. 2, however, the cathode 12 is formed in a two-part manner, with a part 36 near the specimen (removable part) and a part 37 remote from the specimen (fixed part) of the cathode. The part 36 near the specimen is preferably formed with a smaller outside diameter than the part 37 remote from the specimen. The housing 32 extends here over the part near the specimen up to the part 37 remote from the specimen. The peripheral seal 33 provides a sealing effect in particular with respect to the part 37 remote from the specimen, but also with respect to the part 36 near the specimen, and is arranged in the angle between the parts 32, 36, 37.

For removing the specimen 16, the housing 32 is also removable, along with the part 36 near the specimen and the specimen 16, from the glow discharge source 10. Subsequently, an already prepared new housing with another specimen can be fitted. The succession of a number of measurements can therefore be speeded up significantly. The insulator 25 is preferably inserted only in the cathode 12 or the parts 36, 37 and kept there by static friction. The channel 30 runs in the part 37. A guiding tube 38 may be fitted in the free volume 17, and similarly in the other embodiments of the glow discharge source 10.

Figure 5:
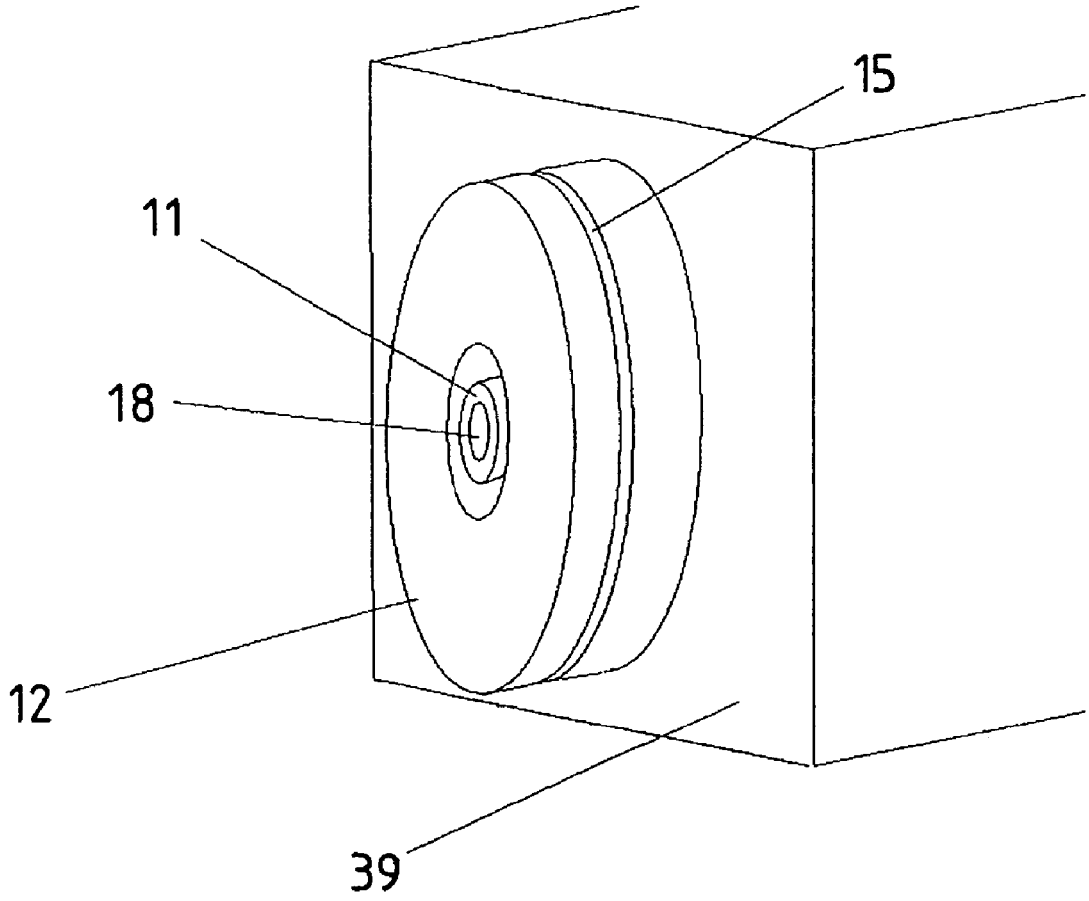
FIG. 5 shows a perspective representation of the glow discharge source.

FIG. 5 shows a simplified perspective representation of the glow discharge source 10 with an analyzer. Of the latter, only the housing wall 39 is indicated here.

Figure 6:
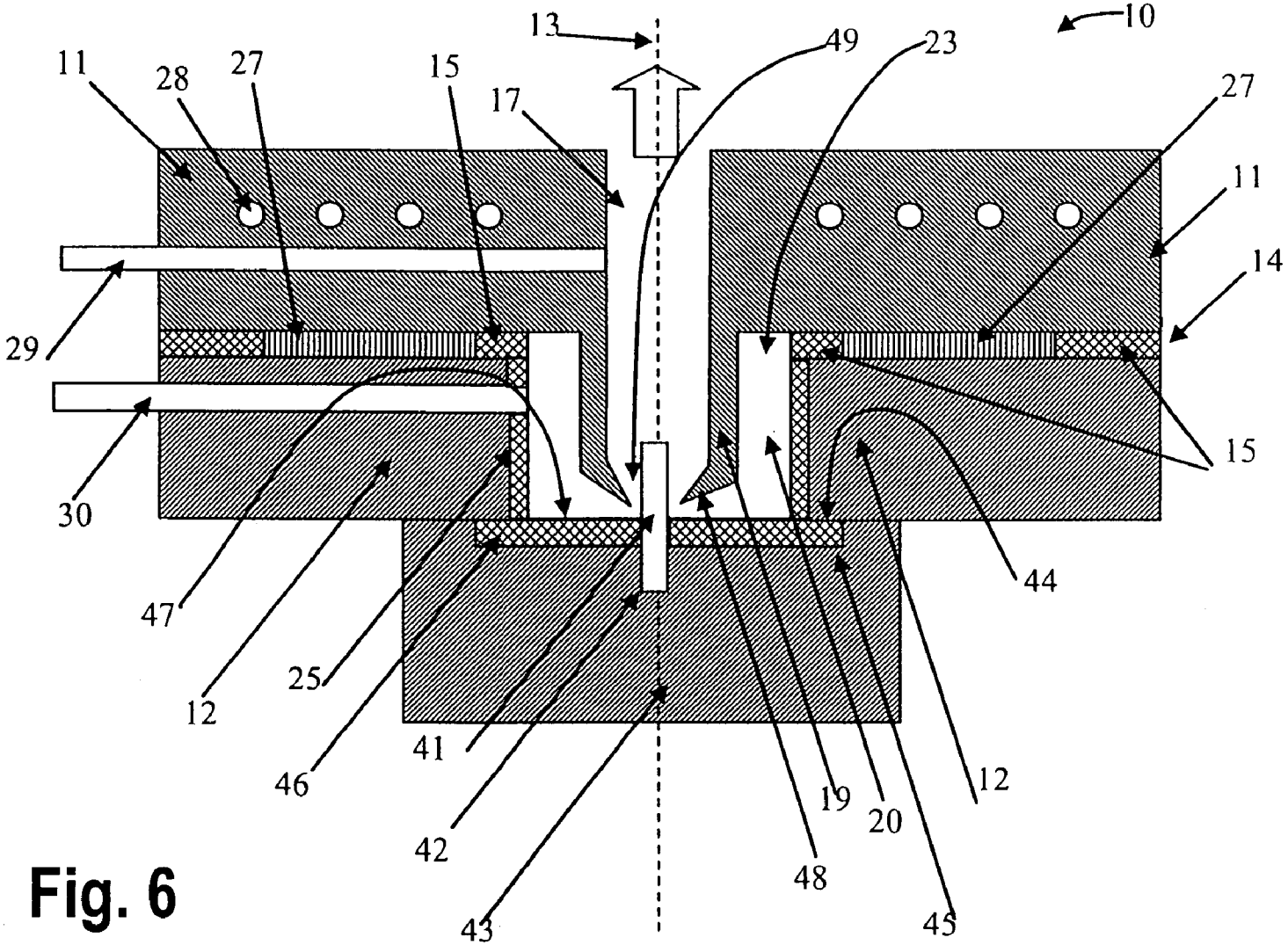
FIG. 6 shows a section along a centre axis of a further embodiment of the glow discharge source according to the invention.

FIG. 6 shows a variation of the glow discharge source according to FIG. 1. Instead of a substantially disc-shaped specimen, a pin-shaped specimen, namely a pin 41, is shown in FIG. 6. This pin is held in a corresponding recess 42 of a holder 43. The pin 41 thereby extends along the centre axis 13, to be precise with part of its length within the recess 42 and with another part of its length into the free volume 17 or into the continuation 19.

The holder 43 lies at the electric potential of the cathode 12 and, for this purpose, lies partly against the cathode 12. To this extent, the holder 43 is a component part of the cathode 12. At least at the edge, the holder 43 otherwise lies directly against the cathode 12, so that a good thermal and electrical transfer is ensured.

The recess 42 is formed in the wall 44 of the holder 43 that lies against the cathode 12. Also provided in the wall 44, substantially concentrically in relation to the recess 42, is a relatively shallow recess 45, in which an insulator 46, for example made of ceramic, lies flush and the free outer side 47 of which lies in part opposite the free volume 17 or the annular volume 20 and with another part lies against the insulator 25 and against the cathode 12. The aim here is to shield the holder 43 from the interior of the glow discharge source. Only the pin 41 lying at cathode potential protrudes into the free volume 17.

On account of the arrangement of the pin 41, the continuation 19 also has a special geometry at its free end 48. The free end 48 forms a constriction with a conically narrowing section and with the smallest diameter in the region of an opening 49, which is arranged near the insulator 46 but still at a distance from it.

The pin 41 extends through the opening 49 into the free volume 17.

The cathode material (including holder 43) is intended to have the best possible thermal and electrical conductivity, while at the same time the greatest possible surface hardness. A tungsten-copper alloy (WCu), or some other alloy with similar properties, for instance copper-chromium (CuCr), tungsten-silver (WAg) or tungsten-carbon-silver (WCAg), is preferred as the material. A tungsten-copper alloy with a tungsten content of 60 to 90% is preferred, in particular W75Cu25.

List of designations:

| | | | |
|---|---|---|---|
| 10 | glow discharge source | 34 | connecting piece |
| 11 | anode | 35 | interior space |
| 12 | cathode | 36 | part near the specimen |
| 13 | centre axis | 37 | part remote from the specimen |
| 14 | gap | | |
| 15 | insulator | 38 | guiding tube |
| 16 | specimen | 39 | housing wall |
| 17 | free volume | 40 | |
| 18 | cathode fall | 41 | pin |
| 19 | continuation | 42 | recess |
| 20 | annular volume | 43 | holder |
| 21 | radial volume | 44 | wall |
| 22 | thickening | 45 | recess |
| 23 | wide portion | 46 | insulator |
| 24 | narrow portion | 47 | free outer side |
| 25 | insulator | 48 | free end |
| 26 | inner side | 49 | opening |
| 27 | Peltier elements | | |
| 28 | cooling channels | | |
| 29 | channel | | |
| 30 | outflow channel | | |
| 31 | arrow | | |
| 32 | housing | | |
| 33 | seal | | |

The invention claimed is:

1. A glow discharge source device for the analysis of solid specimens by means of glow discharge, the device comprising:

an anode, a cathode, and a means for the direct or indirect cooling of the specimen, wherein the cooling means is at least one Peltier element arranged between the anode and the cathode and one of the anode and the cathode is cooled and the other is heated up.

2. The device according to claim 1, wherein the Peltier element abuts the cathode and cools it, and wherein the cathode abuts the specimen.

3. The device according to claim 1, further comprising a means for cooling the anode.

4. The device according to claim 3, wherein the anode has channels for a flowing cooling medium to flow through.

5. The device according to claim 1, wherein the cathode is produced from materials having the following property a) and at least one of the following properties b) and c):

a) a Vickers hardness (HV) of a surface facing the specimen of at least 120, b) an electrical conductivity of at least 14% ICAS, and c) a thermal conductivity of at least 80 $Wm^{-1}K^{-1}$.

6. The device according to claim 1, wherein the cathode is produced from materials having the following property a) and at least one of the following properties b) and c):

a) a Vickers hardness (HV) of a surface facing the specimen of at least 180, b) an electrical conductivity of at least 20% ICAS, and c) a thermal conductivity of at least 100 $Wm^{-1}K^{-1}$.

7. The device according to claim 1, wherein the cathode is produced from at least one material selected from the group consisting of:

W75Cu25,
WCu,
CrZrCu,
CoBeCu,
WAg,
W90NiCu,
CuBe2,
WNiCu,
CuNiBe,
CuCoNiBe,
CuNiCrSi,
CuCr, and
WCAg.

8. The device according to claim 1, wherein the cathode consists of a tungsten-copper alloy.

9. The device according to claim 1, further comprising:

a covering for the cathode, wherein the specimen is completely covered by the covering and the covering has a peripheral sealing edge with respect to the cathode, a volume between the covering and the specimen, and a connection for suction extraction on the covering, wherein the volume between the covering and the specimen can be extracted by suction through the connection for suction extraction.

10. The device according to claim 9, wherein:

the cathode is formed in a divided manner, a part near the specimen and a part remote from the specimen, the part near the specimen is removable together with the specimen, and the covering is removable from the part remote from the specimen.

11. The device according to claim 1, wherein:

the cathode comprises a recess, the anode comprises an opening, and the specimen is formed as a pin having a length, and the specimen is inserted in a conducting manner with part of the length of the specimen in the recess in the cathode and with another part of the length of the specimen into the opening in the anode, without touching the anode.

12. The device according to claim 1, wherein the cathode is produced from materials having the following property a) and at least one of the following properties b) and c):

a) a Vickers hardness (HV) of a surface facing the specimen of at least 210, b) an electrical conductivity of at least 30% ICAS, and c) a thermal conductivity of at least 120 $Wm^{-1}K^{-1}$.

13. A glow discharge source device for the analysis of solid specimens by means of glow discharge, comprising:

an anode, a cathode, and a means for the direct or indirect cooling of the specimen, wherein the cathode is produced from materials with the following property a) and at least one of the following properties b) and c):

a) a Vickers hardness (HV) of a surface facing the specimen is at least 120, b) an electrical conductivity of at least 14% ICAS, and c) a thermal conductivity of at least 80 $Wm^{-1}K^{-1}$.

14. The device according to claim 13, wherein the cathode is produced from at least one material with the following properties:

a) the Vickers hardness (HV) of the surface facing the specimen is at least 180, b) the electrical conductivity is at least 20% ICAS, and c) the thermal conductivity is at least 100 $Wm^{-1}K^{-1}$.

15. The device according to claim 14, wherein the cathode is produced from at least one material selected from the group consisting of:

W75Cu25,
WCu,
CrZrCu,
CoBeCu,
WAg,
W90NiCu,
CuBe2,
WNiCu,
CuNiBe,
CuCoNiBe,
CuNiCrSi,
CuCr, and
WCAg.

16. The device according to claim 15, wherein the cathode consists of a tungsten-copper alloy.

17. The device according to claim 13, wherein:

the cathode comprises a recess, the anode comprises an opening, and the specimen is formed as a pin having a length, and the specimen is inserted in a conducting manner with part of the length of the specimen in the recess in the cathode and with another part of the length of the specimen into the opening in the anode, without touching the anode.

18. The device according to claim 13, further comprising:

a covering for the cathode wherein the specimen is completely covered by the covering and the covering has a peripheral sealing edge with respect to the cathode, a volume between the covering and the specimen, and a connection for suction extraction on the covering, wherein the volume between the covering and the specimen can be extracted by suction through the connection for suction extraction.

19. The device according to claim 18, wherein:

the cathode is formed in a divided manner, a part near the specimen and a part remote from the specimen, the part near the specimen is removable together with the specimen, and the covering is removable from the part remote from the specimen.

20. The device according to claim 13, wherein the cathode is produced from at least one material with the following properties:

a) the Vickers hardness (HV) of the surface facing the specimen is at least 210, b) the electrical conductivity is at least 30% ICAS, and c) the thermal conductivity is at least 120 $Wm^{-1}K^{-1}$.

21. The device according to claim 20, wherein the cathode is produced from at least one material selected from the group consisting of:

W75Cu25,
WCu,
CrZrCu,
CoBeCu,
WAg,
W90NiCu,
CuBe2,
WNiCu,
CuNiBe,
CuCoNiBe,
CuNiCrSi,
CuCr, and
WCAg.

22. The device according to claim 21, wherein the cathode consists of a tungsten-copper alloy.

23. A glow discharge source device for the analysis of solid specimens by means of glow discharge, comprising:

an anode, a cathode, a means for the direct or indirect cooling of the specimen, wherein the cooling means is at least one Peltier element, and a means for cooling the anode, wherein the anode has channels for a flowing cooling medium to flow through.

24. The device according to claim 23, wherein the Peltier element is arranged between the anode and the cathode and one of the anode and the cathode is cooled and the other is heated up.

25. The device according to claim 23, wherein the Peltier element abuts the cathode and cools it, and wherein the cathode abuts the specimen.

26. The device according to claim 23, wherein the cathode is produced from materials having the following property a) and at least one of the following properties b) and c):

a) a Vickers hardness (HV) of a surface facing the specimen of at least 120, b) an electrical conductivity of at least 14% ICAS, and c) a thermal conductivity of at least 80 $Wm^{-1}K^{-1}$.

27. The device according to claim 23, wherein the cathode is produced from materials having the following property a) and at least one of the following properties b) and c):

a) a Vickers hardness (HV) of a surface facing the specimen of at least 180, b) an electrical conductivity of at least 20% ICAS, and c) a thermal conductivity of at least 100 $Wm^{-1}K^{-1}$.

28. The device according to claim 23, wherein the cathode is produced from materials having the following property a) and at least one of the following properties b) and c):

a) a Vickers hardness (HV) of a surface facing the specimen of at least 210, b) an electrical conductivity of at least 30% ICAS, and c) a thermal conductivity of at least 120 $Wm^{-1}K^{-1}$.

29. The device according to claim 23, wherein the cathode is produced from at least one material selected from the group consisting of:

W75Cu25,
WCu,
CrZrCu,
CoBeCu,
WAg,
W90NiCu,
CuBe2,
WNiCu,
CuNiBe,
CuCoNiBe,
CuNiCrSi,
CuCr, and
WCAg.

30. The device according to claim 23, wherein the cathode consists of a tungsten-copper alloy.

31. The device according to claim 23, further comprising:

a covering for the cathode wherein the specimen is completely covered by the covering and the covering has a peripheral sealing edge with respect to the cathode, a volume between the covering and the specimen, and a connection for suction extraction on the covering, wherein the volume between the covering and the specimen can be extracted by suction through the connection for suction extraction.

32. The device according to claim 31, wherein:

the cathode is formed in a divided manner, a part near the specimen and a part remote from the specimen, the part near the specimen is removable together with the specimen, and the covering is removable from the part remote from the specimen.

33. The device according to claim 23, wherein:

the cathode comprises a recess, the anode comprises an opening, and the specimen is formed as a pin having a length, and the specimen is inserted in a conducting manner with part of the length of the specimen in the recess in the cathode and with another part of the length of the specimen into the opening in the anode, without touching the anode.

34. A glow discharge source device for the analysis of solid specimens by means of glow discharge, the device comprising:

an anode, a cathode, a means for the direct or indirect cooling of the specimen, wherein the cooling means is at least one Peltier element, a covering for the cathode, wherein the specimen is completely covered by the covering and the covering has a peripheral sealing edge with respect to the cathode, a volume between the covering and the specimen, and a connection for suction extraction on the covering, wherein the volume between the covering and the specimen can be extracted by suction through the connection for suction extraction.

35. The device according to claim 34, wherein the Peltier element abuts the cathode and cools it, and wherein the cathode abuts the specimen.

36. The device according to claim 34, further comprising a means for cooling the anode.

37. The device according to claim 34, wherein the cathode is produced from materials having the following property a) and at least one of the following properties b) and c):

a) a Vickers hardness (HV) of a surface facing the specimen of at least 120, b) an electrical conductivity of at least 14% ICAS, and c) a thermal conductivity of at least 80 $Wm^{-1}K^{-1}$.

38. The device according to claim 34, wherein the cathode is produced from materials having the following property a) and at least one of the following properties b) and c):

a) a Vickers hardness (HV) of a surface facing the specimen of at least 180, b) an electrical conductivity of at least 20% ICAS, and c) a thermal conductivity of at least 100 $Wm^{-1}K^{-1}$.

39. The device according to claim 34, wherein the cathode is produced from materials having the following property a) and at least one of the following properties b) and c):

a) a Vickers hardness (HV) of a surface facing the specimen of at least 210, b) an electrical conductivity of at least 30% ICAS, and c) a thermal conductivity of at least 120 $Wm^{-1}K^{-1}$.

40. The device according to claim 34, wherein the cathode is produced from at least one material selected from the group consisting of:

W75Cu25,
WCu,
CrZrCu,
CoBeCu,
WAg,
W90NiCu,
CuBe2,
WNiCu,
CuNiBe,
CuCoNiBe,
CuNiCrSi,
CuCr, and
WCAg.

41. The device according to claim 34, wherein the cathode consists of a tungsten-copper alloy.

42. The device according to claim 34, wherein:

the cathode is formed in a divided manner, a part near the specimen and a part remote from the specimen, the part near the specimen is removable together with the specimen, and the covering is removable from the part remote from the specimen.

43. The device according to claim 34, wherein:

the cathode comprises a recess, the anode comprises an opening, and the specimen is formed as a pin having a length, and the specimen is inserted in a conducting manner with part of the length of the specimen in the recess in the cathode and with another part of the length of the specimen into the opening in the anode, without touching the anode.

44. A glow discharge source device for the analysis of solid specimens by means of glow discharge, the device comprising:

an anode, a cathode produced from materials having the following property a) and at least one of the following properties b) and c):

a) a Vickers hardness (HV) of a surface facing the specimen of at least 120, b) an electrical conductivity of at least 14% ICAS, and c) a thermal conductivity of at least 80 $Wm^{-1}K^{-1}$, and a means for the direct or indirect cooling of the specimen, wherein the cooling means is at least one Peltier element.

45. The device according to claim 44, wherein the Peltier element abuts the cathode and cools it, and wherein the cathode abuts the specimen.

46. The device according to claim 44, further comprising a means for cooling the anode.

47. The device according to claim 44, wherein the cathode is produced from at least one material with the following properties:

a) a Vickers hardness (HV) of a surface facing the specimen of at least 120, b) an electrical conductivity of at least 14% ICAS, and c) a thermal conductivity of at least 80 $Wm^{-1}K^{-1}$.

48. The device according to claim 44, wherein the cathode is produced from at least one material with the following properties:

a) a Vickers hardness (HV) of a surface facing the specimen of at least 180, b) an electrical conductivity of at least 20% ICAS, and c) a thermal conductivity of at least 100 $Wm^{-1}K^{-1}$.

49. The device according to claim 44, wherein the cathode is produced from at least one material with the following properties:

a) a Vickers hardness (HV) of a surface facing the specimen of at least 210, b) an electrical conductivity of at least 30% ICAS, and c) a thermal conductivity of at least 120 $Wm^{-1}K^{-1}$.

50. The device according to claim 44, wherein the cathode is produced from at least one material selected from the group consisting of:

W75Cu25,
WCu,
CrZrCu,
CoBeCu,
WAg,
W90NiCu,
CuBe2,
WNiCu,
CuNiBe,
CuCoNiBe,
CuNiCrSi,
CuCr, and
WCAg.

51. The device according to claim 44, wherein the cathode consists of a tungsten-copper alloy.

52. The device according to claim 44, further comprising:

a covering for the cathode, wherein the specimen is completely covered by the covering and the covering has a peripheral sealing edge with respect to the cathode, a volume between the covering and the specimen, and a connection for suction extraction on the covering, wherein:

a) the volume between the covering and the specimen can be extracted by suction through the connection for suction extraction, b) the cathode is formed in a divided manner, a part near the specimen and a part remote from the specimen, and c) the part near the specimen is removable together with the specimen and the covering is removable from the part remote from the specimen.

53. A glow discharge source device for the analysis of solid specimens by means of glow discharge, the device comprising:

an anode, a cathode, and a means for the direct or indirect cooling of the specimen, wherein the cooling means is at least one Peltier element arranged between the anode and the cathode and one of the anode and the cathode is cooled and the other is heated up, and wherein the anode and the cathode are located on a same side of the specimen.

54. The device according to claim 53, wherein the at least one Peltier element is arranged between the anode and the cathode and one of the anode and the cathode is cooled and the other is heated up.

55. The device according to claim 53, wherein the Peltier element abuts the cathode and cools it, and wherein the cathode abuts the specimen.

56. The device according to claim 53, further comprising a means for cooling the anode.

57. The device according to claim 56, wherein the anode comprises channels for a flowing cooling medium to flow through.

58. The device according to claim 53, wherein the cathode is produced from materials having the following property a) and at least one of the following properties b) and c):

a) a Vickers hardness (HV) of a surface facing the specimen of at least 120, b) an electrical conductivity of at least 14% ICAS, and c) a thermal conductivity of at least 80 $Wm^{-1}K^{-1}$.

59. The device according to claim 53, wherein the cathode is produced from materials having the following property a) and at least one of the following properties b) and c):

a) a Vickers hardness (HV) of a surface facing the specimen of at least 180, b) an electrical conductivity of at least 20% ICAS, and c) a thermal conductivity of at least 100 $Wm^{-1}K^{-1}$.

60. The device according to claim 53, wherein the cathode is produced from materials having the following property a) and at least one of the following properties b) and c):

a) a Vickers hardness (HV) of a surface facing the specimen of at least 210, b) an electrical conductivity of at least 30% ICAS, and c) a thermal conductivity of at least 120 $Wm^{-1}K^{-1}$.

61. The device according to claim 53, wherein the cathode is produced from at least one material selected from the group consisting of:

W75Cu25,
WCu,
CrZrCu,
CoBeCu,
WAg,
W90NiCu,
CuBe2,
WNiCu,
CuNiBe,
CuCoNiBe,
CuNiCrSi,
CuCr, and
WCAg.

62. The device according to claim 53, wherein the cathode consists of a tungsten-copper alloy.

63. The device according to claim 53, further comprising:

a covering for the cathode, wherein the specimen is completely covered by the covering and the covering has a peripheral sealing edge with respect to the cathode, a volume between the covering and the specimen, and a connection for suction extraction on the covering, wherein:

a) the volume between the covering and the specimen can be extracted by suction through the connection for suction extraction, b) the cathode is formed in a divided manner, a part near the specimen and a part remote from the specimen, and c) the part near the specimen is removable together with the specimen and the covering is removable from the part remote from the specimen.

64. The device according to claim 53, wherein:

the cathode is formed in a divided manner, a part near the specimen and a part remote from the specimen, the part near the specimen is removable together with the specimen, and the covering is removable from the part remote from the specimen.

65. The device according to claim 53, wherein:

the cathode comprises a recess, the anode comprises an opening, and the specimen is formed as a pin having a length, and the specimen is inserted in a conducting manner with part of the length of the specimen in the recess in the cathode and with another part of the length of the specimen into the opening in the anode, without touching the anode.

* * * * *